United States Patent [19]

Walser et al.

[11] Patent Number: 4,791,970

[45] Date of Patent: Dec. 20, 1988

[54] VENEER LATHES HAVING VENEER THICKNESS SENSOR AND THICKNESS CONTROL

[75] Inventors: Donald C. Walser, Surrey; Michael R. Clarke, West Vancouver, both of Canada

[73] Assignee: Forintek Canada Corp., Vancouver, British Columbia, Canada

[21] Appl. No.: 130,093

[22] Filed: Dec. 7, 1987

[51] Int. Cl.[4] ..... B27B 1/00; B27L 5/02

[52] U.S. Cl. ..... 144/213; 144/357; 144/365; 364/474

[58] Field of Search ..... 144/209 R, 213, 213 A, 144/356, 357, 365; 364/474

[56] References Cited

U.S. PATENT DOCUMENTS 4,708,180 11/1987 Browning, Jr. et al. ..... 144/357

*Primary Examiner*—W. Donald Bray

*Attorney, Agent, or Firm*—Shlesinger, Arkwright & Garvey

[57] ABSTRACT

A wood veneer lathe that includes a sensor carried by the nose bar and co-acting with the peeling knife to detect and provide an output signal in response to and proportioned to deviations from a predetermined spacing of the nose bar and knife relative to one another. The sensor is located downstream from the point of contact of the nose bar with the block at a position opposite a flate face of the knife and adjacent the latters cutting edge. A particular veneer lathe is disclosed that includes electrohydraulic linear actuators with feedback control means for adjustably positioning the peeling knife. Signals from the sensor, detecting deviations of the peeling knife from its fixed setting, are analyzed by a computer and the latter controls actuators to make suitable knife position adjustments to control the veneer thickness.

37 Claims, 6 Drawing Sheets

VENEER LATHES HAVING VENEER THICKNESS SENSOR AND THICKNESS CONTROL

FIELD OF INVENTION

This invention relates to lathes for making wood veneer, and more particularly to such lathes in combination with means to measure the thickness of the veneer as it is cut in the form of a ribbon from the log. The signals derived from such measurement are used to control the veneer thickness. The invention also concerns novel control means for adjustably positioning and controllably moving the peeling knife of a lathe.

BACKGROUND OF INVENTION

Lathes are used to cut veneer, in the form of a ribbon, from a wood log or block as the block is rotated. Typically lathes include an arrangement for rotating the wood block, a knife and a pressure bar, and may be either a spindle or spindleless type. In the spindle type there are two axially spaced head stocks that support the log and at least one head stock is driven for rotating the wood block. The spindleless type lathe typically has three parallel rollers that hold the wood block captive and at least one of such rollers is driven to rotate the block. In either type an adjustably movable knife is used to peel a ribbon of veneer from the block as the block is rotated. In any veneer forming apparatus the principal objective is to produce a ribbon of veneer that is of uniform and precise thickness.

Veneer must meet certain minimum quality standards and the thickness must be within a few thousands of an inch of the average. This precise thickness is necessary for the veneer to accept sufficient glue with a roll type spreader or to prevent panel rejection because of being too thin or to avoid excessive sanding losses. Veneer must be strong enough to avoid breakage during handling, and loose enough to be handled by automatic equipment, yet smooth enough to ensure proper glue distribution at the glue spreader. Multi layers of veneer are often laminated together to produce a panel product and uniformity of veneer thickness yields panels that are uniform.

The actual yield and quality of veneer is dependent upon lathe related variables, and as far as veneer quality is concerned, control is required for variable parameters such as smoothness, tightness and thickness variability.

PRIOR ART

With a view to accomplishing the objective of quality control, most lathes use a nose bar in association with the knife.

Veneer thickness control is the subject of U.S. Pat. No. 4,392,519, issued July 12, 1983 to H. B. Calvert, which discloses a nose bar and peeling knife assembly wherein the pitch angle of the peeling knife is varied in response to knife deflection. A sensor mounted in the knife holder is used to detect the direction and amplitude of lateral deflection of the knife edge from a condition of substantial equilibrium during veneer peeling. If the deflection of the knife is towards the block the knife is said to be "leading", and conversely, if the knife is deflected away from the workpiece, it is undergoing "heeling". A leading knife usually causes the knife and log to vibrate and the lathe will then produce a corrugated veneer of irregular thickness. A heeling knife tends to move in and out of the log producing alternately thick and thin veneer. A strain guage sensor detects the direction and amplitude of deflection of the knife relative to the knife support bar and from a corresponding signal that is generated a signal responsive controller causes the knife, which is either in a leading or heeling condition, to return to its optimum pitch angle condition. Without deflecting sensing and controlling means, the pitch angle (being the angle between a horizontal plane and the plane of the cutting edge of the peeling knife facing the block) will vary from its pre-established setting.

The knife conventionally is guided along curved pitch tracks, or by inclined rails as in the Calvert patent, as it moves into the block so that the pre-established pitch angle is caused to decrease as the diamter of the block being peeled decreases. The purpose of this is to maintain as close as possible the optimum pitch angle.

In the Calvert form of construction, the signal from the strain guage, which detects blade deflection, is used to effect a correction to the pitch angle as it follows along its guide tracks, so as to maintain the knife in approximate balance, and which is achieved by varying the angle of the inclined rails in response to the signal.

Because Calvert has located the strain guage on the cutting knife holder and downstream of the cutting edge of the peeling knife, it is susceptable to malfunctioning because of debris accumulating in the area of the strain guage. Because of such location the strain guage is also exposed to the deleterious effect of steam and water.

SUMMARY OF THE INVENTION

The present invention, like Calvert discussed above, uses a sensor that co-acts with the knife, but unlike Calvert provides a direct measurement of the veneer thickness as the veneer is being peeled from the log. The novel sensor arrangement of this invention can be utilized with known pitch angle adjustment means such as hitherto taught by Calvert in the aforementioned United States Patent, or variable length cylinder means as disclosed herein. In an extremely simple application the sensor can be used merely to measure the thickness of the veneer or for example the start up of a run and if any change is necessary it can be done by manual adjustment.

In the Calvert apparatus, deflection of the cutting knife relative to the structure on which the cutting knife is mounted is monitored and this provides perhaps in one sense an indication of veneer thickness, i.e. thicker or thinner than normal, because what is being sensed is whether the knife is a heeling or leading knife, or in equilibrium. In accordance with the present invention, a direct measurement of the veneer thickness is sensed by continuously monitoring the relative position of the peeling knife and the lathe nose bar. This is achieved by locating the sensor means so that it is carried by or otherwise associated with the nose bar itself, and so positioned that a signal from the sensor can co-act with the knife (e.g. being reflected therefrom), whereby blade movement relative to the nose bar is directly measured and such measurement is a direct function of changes in the thickness of the veneer being peeled. This sensor is normally located in reflective relationship to a major plane of the cutting knife (preferrably closely adjacent the knife's cutting edge). A commercially available sensor suitable for such purpose is the Kaman Displacement Measuring System.

As the sensor is spaced from the peeling knife and at no time is in direct contact with the knife, its operation is not adversely affected by the hostile environment resulting from steam, water and debris encountered during veneer production. Further, the sensor being on the pressure or nose bar permits using the invention on both conventional and "spindless" veneer lathes.

In accordance with the present invention the lathe, with the veneer thickness sensor, can have a solid, non-rotating, elongate nose bar, which nose bar has been traditional in the industry, or a rotatable (driven or idler) pressure roller which displays all of the attributes of a conventional non-rotating nose bar, but provides greater support to the block.

In addition to the above features, where a pressure roller is used as a nose bar, and whether or not the pressure roller is used on a conventional or spindless lathe, the pressure roller itself can itself advantageously include a plurality of knife-like projections for incising or tenderizing the veneer.

In accordance with a further aspect of the present invention there is provided veneer lathes having log and/or knife peeling position adjusting means and which are responsive to a veneer thickness sensor.

In accordance with a further aspect of the present invention there is provided in a veneer lathe of the type including means for supporting a bolt of wood and rotating such bolt about its longitudinal axis and a veneer peeling knife and pressure nose bar disposed in a predetermined spaced relationship relative to one another, said peeling knife and pressure nose bar being supported on a movable carriage for peeling veneer in ribbon-form from the outside of said bolt as the latter is rotated, the improvement comprising sensor means carried by said nose bar and co-acting with said knife to detect variations in said predetermined spacing of the peeling knife and nose bar and providing output signals in response and proportioned to such variations.

In accordance with a further aspect of the present invention there is provided a veneer lathe comprising (a) a rigid frame structure having head stocks for carrying and rotating a log to be peeled into a ribbon of veneer;

(b) a nose bar and peeling knife mounted in predetermined spaced relationship relative to one another on a carriage;

(c) means reciprocally mounting said carriage on said frame structure for movement toward and away from said log;

(d) power means for moving said carriage toward said log at a predetermined rate to peel a ribbon of veneer from the log as it is rotated;

(e) means pivotally mounting said carriage for movement about an axis parallel to the axis of rotation of the log for permitting adjusting the knife pitch angle;

(f) power means for selectively pivoting said carriage; and (g) means mounting said carriage permitting movement of the same to selectively vary the gap between the knife tip and point of contact of the nose bar with the log.

In accordance with a still further aspect of the present invention there is provided a veneer lathe of the type including means for supporting and rotating a bolt of wood about its longitudinal axis and a veneer peeling knife and pressure nose bar assembly having a predetermined fixed spacing therebetween and which is supported on a movable carriage for peeling veneer in ribbon form from the outside of said bolt as the latter is rotated, the improvement comprising sensor means carried by said nose bar and operative to detect and provide an output signal in response to variations in said predetermined fixed spacing of the knife and nose bar and magnitude of such variation and means for adjustably repositioning the peeling knife in response to commands from a controller acting in response to signals from said sensor means.

BRIEF DESCRIPTION OF THE DRAWINGS

The invention is illustrated by way of example in the accompanying drawings wherein.

DESCRIPTION OF PREFERRED EMBODIMENTS

Figure 1:
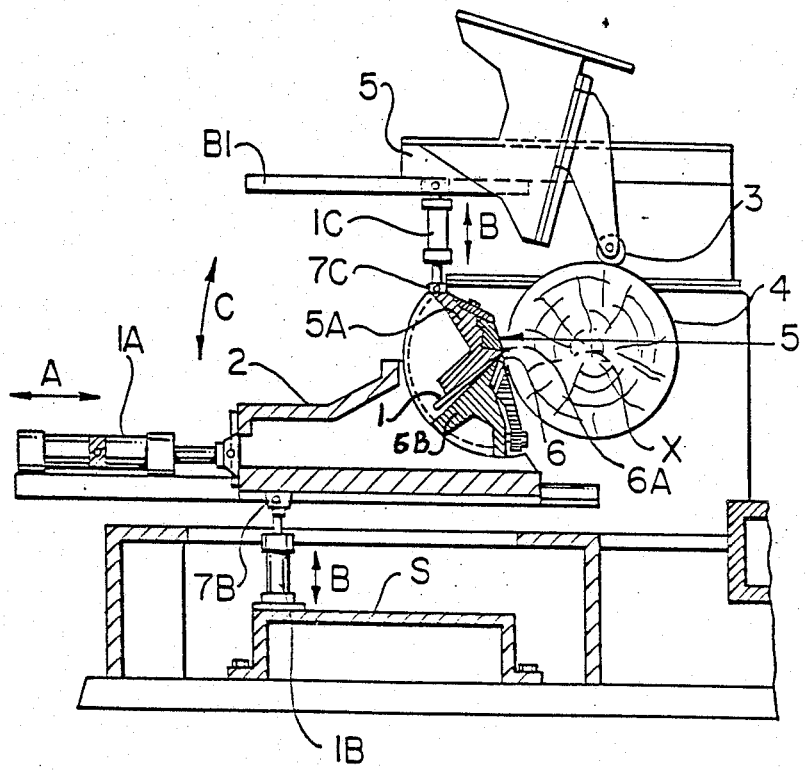
FIG. 1 is a schematic cross-sectional view of a lathe with a conventional rigid nose bar and peeling knife including a knife position adjusting means provided in accordance with the present invention.

In FIG. 1 there is illustrated in partial cross-section a spindle type lathe where, in a conventional manner, a log or wood block is supported between and on a pair of rotatably mounted chucks at least one of which is driven to rotate the log about an axis designated X. A knife 6 is presented to the log and peels therefrom a ribbon 1 of veneer as the log rotates. A nose bar 5 detachably mounted (as by clamps) on a supporting rigid structure 5A bears against the outer surface of the log slightly upstream from the cutting tip 6A of the peeling knife 6. The knife 6 is mounted on a knife holder 6B. The knife holder 6B and nose bar support 5A is a rigid assembly pivotally mounted on the carriage 2. Pivotal movement of the assembly is about the tip of the blade. There have been various studies on the effect of varying lathe related parameters on quality of the veneer, such as relative positioning of the nose bar and knife, and two which might be mentioned for those wanting further information are: (a) a report in the *Forest Products Journal*, October 1966, Volume 16, No. 10, entitled "Effects of Horizontal Roller Bar Openings and Quality of Rotary Cut Southern Pine and Yellow Poplar Veneer", by J. F. Lutz and R. A. Patzer, and (b) a report in *Wood Science*, January 1980, Volume 12, No. 3, entitled "Effect of Four Foot Lathe Parameters on Veneer Yield and Quality Using Response Service Analysis", by J. R. T. Haley, W. P. Hancock and W. G. Warren.

One of the main adjustments or variables in a lathe is the pitch of the knife or the knife angle which must be varied depending upon the kind of wood and the thickness of veneer being produced, and furthermore must be varied as the diameter of the log decreases and the veneer is peeled away from the log. To accommodate the latter, and as previously mentioned, the knife carriage conventionally has been mounted on curved rails or tilted by a cam action during movement, as is the case with the structure illustrated in FIG. 2 of Calvert's aforementioned U.S. Pat. No. 4,392,519. In addition to changing the pitch angle, the knife is mounted on a carriage movable laterally in a direction toward and away from the spindle axis.

With respect to the present apparatus carriage 2 is reciprocally movable in a horizontal plane to the left and right (double headed arrow A) as viewed in FIG. 1 by one or more hydraulic, electrohydraulic (or pneumatic) cylinder units 1A. The carriage unit 2 can be raised and lowered in a vertical direction (double headed arrow B) by a further hydraulic cylinder (or pneumatic) cylinder unit 1B is attached at one end to the fixed structure 5 and the other end by pivot pin 7B to the carriage 2.

The knife carriage 2 is provided with both reciprocal and vertical movement. In addition to this, the knife and nose bar is movably mounted on the carriage for movement in an arcuate path (double headed arrow C) about an axis parallel to the axis of rotation X of the log 4 for varying the knife pitch angle. This arcuate movement is effected by a hydraulic cylinder unit 1C attached at one end as by a bar B1 to slide on frame structure S, and at the other end by a pivot pin 7C to the structure that carries the nose bar and cutting knife. The bar B1 is movable with the carriage structure 2.

From the foregoing, it can be seen the hydraulic cylinders 1A, 1B and 1C adjustably control movement and variable positioning of the peeling knife 6 relative to the log or wood block which remains in a fixed position. The log during its rotation is further supported by a back up-roll 3 in a conventional manner, and which is movable and in pressural engagement with the log. The hydraulic cylinders 1A, 1B and 1C are each of the electro-hydraulic type recently coming into use for controlling machine operations. These servoactuators move loads at high speed with high accuracy and they permit quick changes in machine operation. There are a number of different electro-hydraulic actuators with various feedback systems that may be either mechanical or electrical or a combination thereof. The systems vary in accuracy, dependability and complexity, and not all are suited for every application. For the present application, the method of feedback control is knowns as the Tempasonic TM LTD which is a linear actuator manufactured by a number of companies, including Aeroquip Corporation, Moog Inc., and Parker, Hannifin Corp.. The transducer has no moving parts and thus wear is not a problem. It is fairly tolerant of vibration and shock loads, and has a positioning accuracy of 0.001 to 0.003 inches.

Figure 2A:
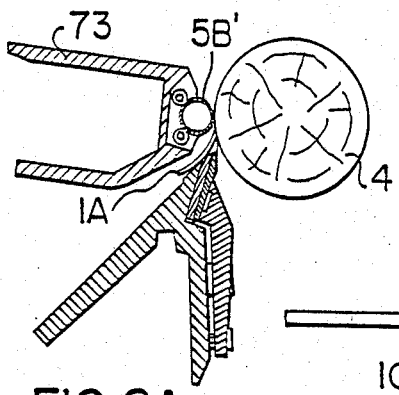
FIG. 2A is a partial view similar to FIG. 2 illustrating a roller nose bar with incising teeth.
Figure 2:
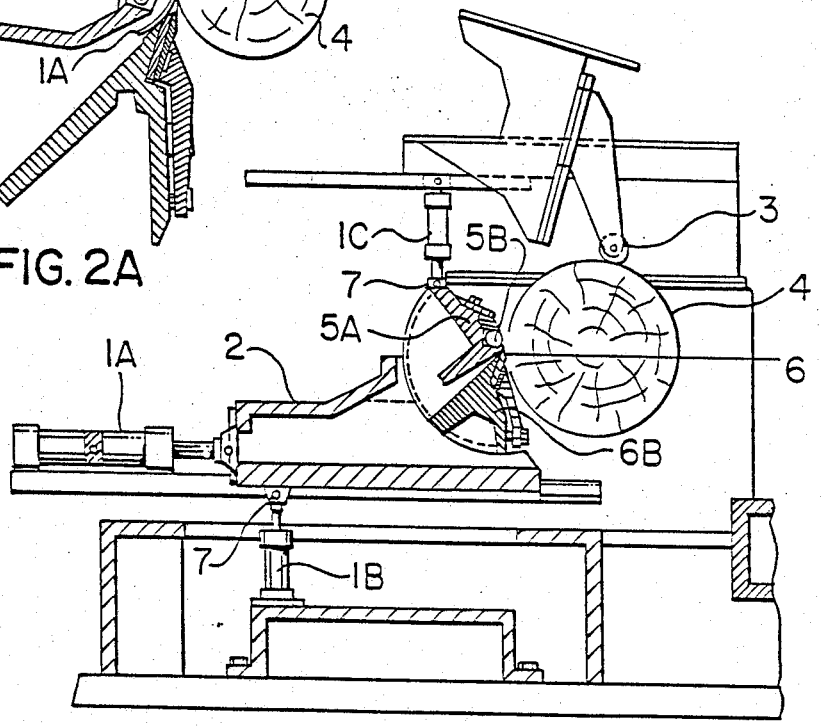
FIG. 2 is similar to FIG. 1 but where the nose bar is a roller type.

The lathe system illustrated in FIG. 2 is essentially the same as in FIG. 1, except for the nose bar. In the lathe of FIG. 2 the nose bar is what is referred to as a "big bar" and consists of a roller 5B mounted for rotation on a rigid nose bar of mounting structure 5A. The lathe is a spindle type lathe with a roller nose bar, the nose bar being movable along with the cutting knife and therefore somewhat different from the roller nose bar in a centreless lathe, as disclosed in U.S. Pat. No. 4,335,764, issued June 22, 1982 to Charles J. Schmidt.

FIG. 2A illustrates a roller nose bar type lathe of FIG. 2 but where the roller designated 5B' has knife like projections on the peripheral surface for incising the wood prior to peeling the veneer 1A from the log 4.

In each of the lathes illustrated in FIGS. 1, 2 and 2A there is a sensor mounted in such a manner as to determine any deviation or change in positioning of the lathe knife 6 relative to the nose bar. This, by appropriate calibration, gives a direct reading of the thickness of the veneer being peeled.

Figure 3:
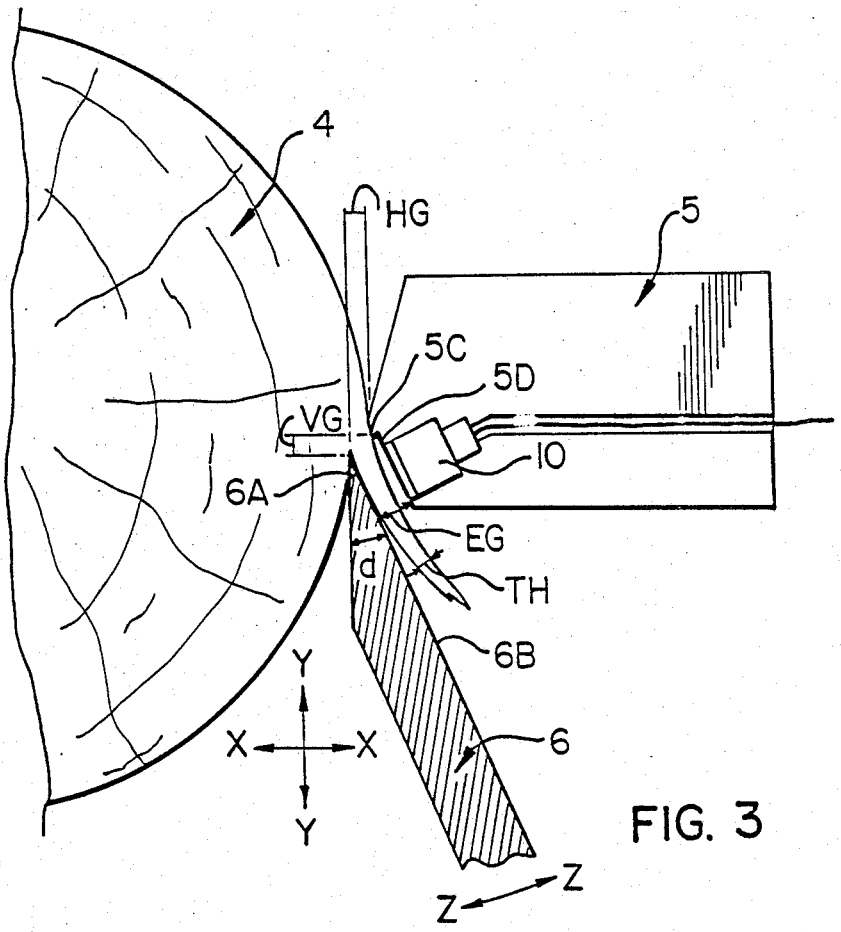
FIG. 3 is an enlarged, partial cross-sectional, view of the lathe of FIG. 1 illustrating a veneer thickness sensor mounted on the nose bar.

In FIG. 3, which is an enlarged cross-sectional view of the nose bar and log for the lathe of FIG. 1, a sensor 10 is mounted in the nose bar 5 at a location downstream from the tip 5C of the nose bar that engages the log 4. The nose bar, downstream from the log engaging tip portion 5C, is recessed so as to provide an exit gap designated EG, at the back face 6B of the knife which is greater than the horizontal gap designated HG between the nose bar tip 5C and the leading cutting edge 6A of the knife. This exit gap EG is greater than the thickness of the veneer designated TH allowing for free flow escape of the veneer as it is peeled from the log.

The sensor 10, in the recessed face 5D of the nose bar, is a transducer such as model type KD-2310-6U manufactured by Kaman Instrumentation Corporation of Colorado Springs, Colo. which serves to continuously measure in electrical impulse form, in a manner known, the distance and any variation in the distance between the sensor 10 and the opposed backface designated 6B of the cutting knife 6. As will be clearly evident from FIG. 3, the sensor 10 is located in close proximity or vicinity of the tip 6A of the knife, and thus any deviation of the knife from its designated or set position is picked up immediately that such deviation occurs. This allows for implementing corrective immediate action should it be required. The operation of the sensor or transducer 10 is unaffected by the presence and movement of the veneer sheet 1 between the sensor and the cutting blade.

The nose bar illustrated in the lathe of FIG. 2 is a roller 5B having a central shaft 20 (FIG. 4) journalled by suitable means at opposed ends on bearings on the nose bar support structure 5A and is further supported by a center bearing mid-way along the length of the roll with such bearing being carried by a support 22. Mounted on the support 22 is a sensor 10 spaced a selected distance Y from the rear face 6B of the peeling knife 6. The tip 6A of the peeling knife is spaced from the contact point of the roller with the log providing a horizontal gap HG which is slightly less than the distance between the roller and the rear face 6B of the cutting knife. The positioning of the sensor, relative to the rear face 6B of the blade, is co-related to the horizontal gap HG and thereby provides a direct reading, through suitable calibration, of the thickness of the veneer being peeled, and any deviation from that thickness provides a signal in the form of electrical impulses conducted by way of a wire 30 to a suitable controller rendering commands to actuate cylinders designated in FIGS. 1 and 2 as 1A, 1B and/or 1C.

The pressure roller 5B, depending upon its application, can vary in diamter from about 1 inch to about 6 inches, and is preferably within the range of 4 to 6 inches. Further, and again depending upon its application, the pressure roller may simply be an idler, or alternatively a driven roller. Also, the pressure as for example, roller 5B' can be provided with a plurality of cutting teeth about its peripheral surface for tenderizing or incising the block, and hence the resultant peeled veneer.

The lathes illustrated in the foregoing embodiments are of the spindle type in which the log is located between and carried by end plates or chucks that are rotated about a predetermined axis of rotation. In such lathes it is also known to uses additional rolls as idlers or powered to engage and support the log during peeling.

Figure 5:
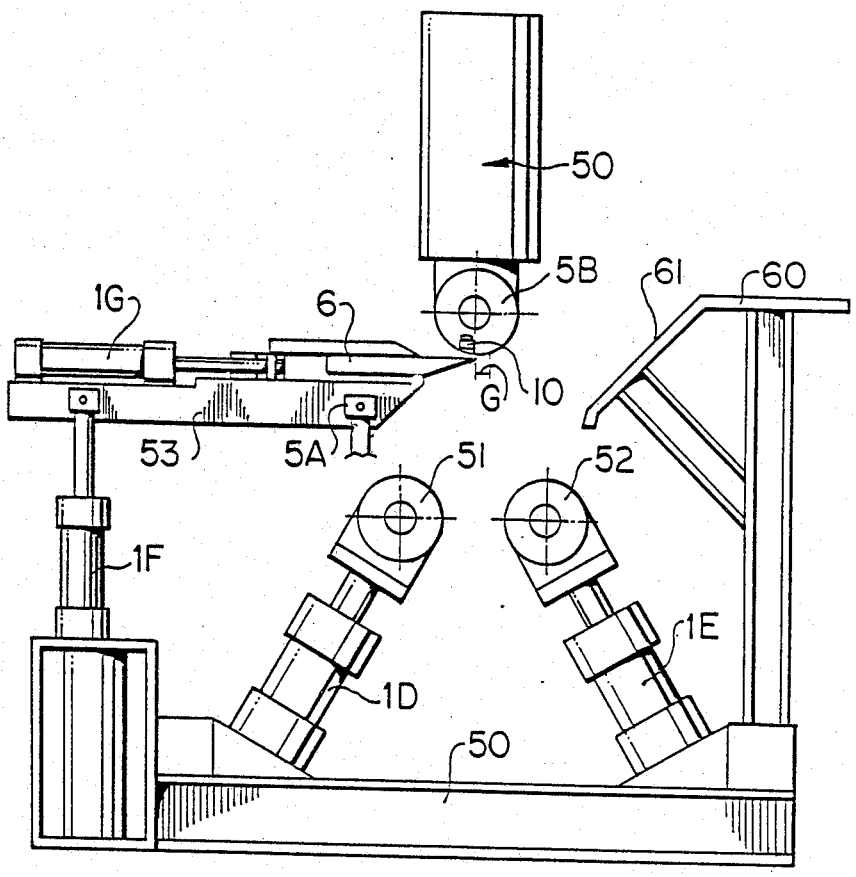
FIG. 5 is a diagrammatic cross-sectional view of a spindleless lathe with a veneer thickness sensor mounted on the support of one of the rollers.

FIG. 5 is a basic sectional view of a spindleless or centerless lathe as referred to in the aforementioned U.S. Pat. No. 4,335,764, and which in turn refers to U.S. Pat. Nos. 1,951,834 and 4,073,326, as disclosing centerless veneer lathes.

The centerless lathe conventionally consists of three parallel rollers, one of which is fixed in position, and the other two movable relative thereto for receiving and holding captive a log. One or more of the rollers are driven to rotate the log, and one or more of the rollers can be provided with incising teeth to tenderize or incise the veneer.

Figure 4:
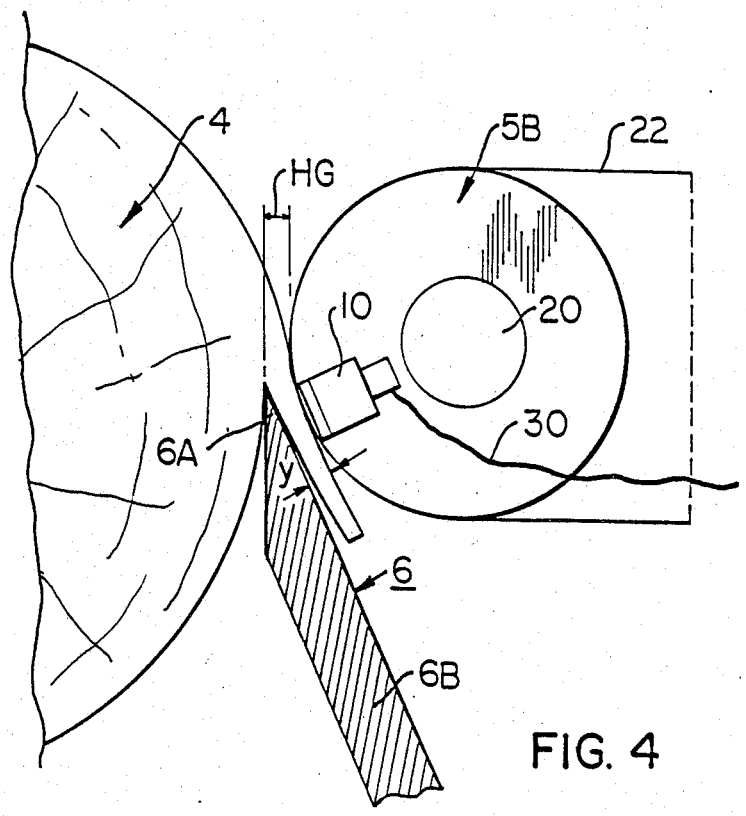
FIG. 4 is an enlarged partial cross-sectional view, similar to FIG. 3, of the lathe shown in FIGS. 2 or 3 illustrating the sensor mounted on a support for the roller nose bar.

Referring to FIG. 5 there is illustrated a first roll 5B of the type illustrated in FIG. 4, having mounted thereon and carrying therewith a sensor 10, roller 5B being in a fixed location and carried by a structure designated 50. Two further rollers designated 51 and 52 are mounted on structures carried by the piston rod of respective Tempasonic TM hydraulic cylinder units 1D and 1E. These hydraulic cylinders 1D and 1E are fixed to the mounting structure 50. A further Tempasonic TM cylinder 1F is anchored to the support structure 50 and has a piston rod connected to the carriage structure 53 having the peeling knife 6 reciprocally mounted thereon. The peeling knife 6 is controllably moved horizontally, as viewed in FIG. 5, by a hydraulic Tempasonic TM cylinder 1G to change selectively a gap designated G that corresponds to the vertical gap VG of FIG. 3.

From this embodiment it is clearly evident log supporting rollers 51 and 52 (at least one of which may be driven) are movable toward and away from roller 5B, the three rollers holding captive a log and rotating the same during peeling of the veneer. The peeling knife 6 is controllably varied in pitch by actuation of the hydraulic cylinder 1F (pivoting being about pin 5A) and the gap G is varied by actuation of the hydraulic cylinder 1G. Logs to be peeled are infed from a bed 60 on the support structure 50, and which has and inclined portion 51 directed downwardly to the gap between roller 52 and roller 5B.

In the FIG. 5 embodiment the veneer thickness can be modified or controlled by actuating cylinder unit 1G to move knife 6 into or out of the cut, by actuating cylinder unit 1F to pivot the knife support frame 53 (pivot of rotation being the knife tip) and/or actuation of cylinder units 1D and 1E varying the roll positions and thus changing the angle at which the block is presened to the knife.

Figure 5A:
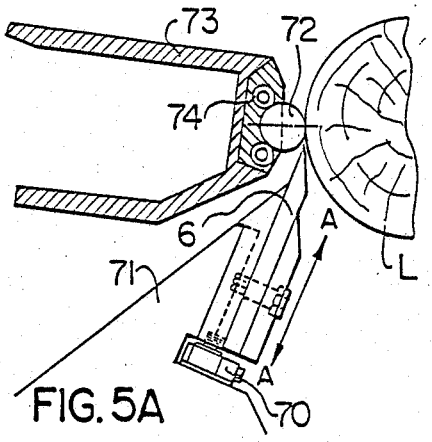
FIG. 5A is a view similar to FIG. 2A but illustrating a modified mounting for adjusting and controlling the knife position.
Figure 6:
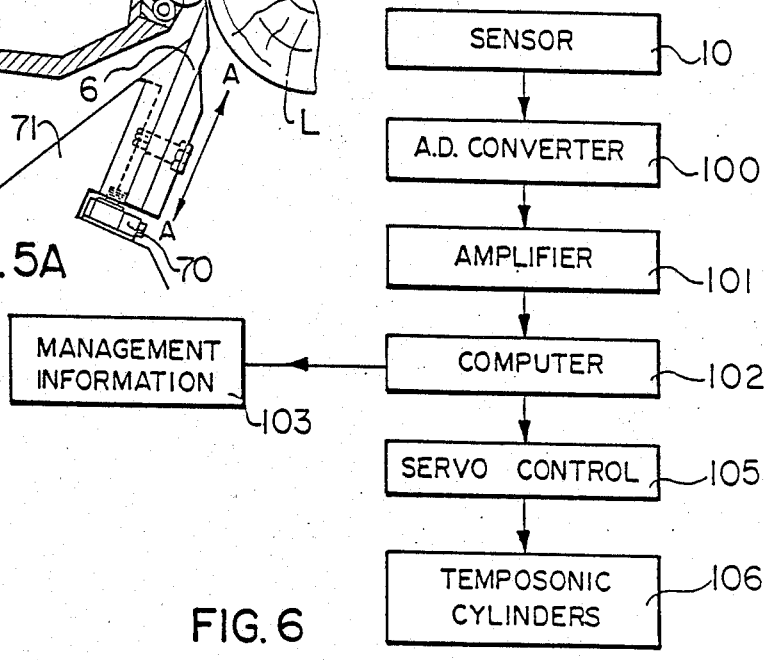
FIG. 6 is a block diagram of the lathe veneer thickness control system of the present invention actuated by a veneer thickness sensor.

FIG. 5A illustrates an alternative to the embodiments of FIGS. 1, 2 and 2A where the cutting knife is fixedly secured to the knife holder. In FIG. 5A the peeling knife 6 is reciprocally mounted on the knife holder for movement along a path parallel to arrow A—A. The direction of path A—A relative to the log, the location of the knife and/or the pitch of the knife can be chosen as may be required to give the desired thickness control by moving the knife along the predetermined path. Movement of the knife 6 is effected by a Tempsonic TM cylinder unit 70 mounted on the knife holder 71. Log L is rotatably supported between a pair of end plates (not shown) and a roller nose bar 72 is journalled on a rigid bar 73 and engaged by support rollers 74. The knife 6 is reciprocally mounted in any convenient manner.

We claim:

1. In a veneer lathe of the type including means for supporting a bolt of wood and rotating such bolt about its longitudinal axis and a veneer peeling knife and pressure nose bar disposed in a predetermined spaced relationship relative to one another, said peeling knife and pressure nose bar being supported on a movable carriage for peeling veneer in ribbonform from the outside of said bolt as the latter is rotated, the improvement comprising sensor means carried by said nose bar and acting with said knife to detect variations in said predetermined spacing of the peeling knife and nose bar and providing output signals in response and proportioned to such variations.

2. The veneer lathe as claimed in claim 1, wherein said sensor means, carried by said nose bar, is positioned downstream from the point of contact of said nose bar with said block, and opposite a face of said knife adjacent the cutting edge thereof.

3. The veneer lathe as claimed in claim 2, wherein said sensor means is located centrally of the longitudinal extent of said nose bar.

4. The veneer lathe as claimed in claim 3, wherein said nose bar which contacts the bolt of wood comprises a roller.

5. The veneer lathe as claimed in claim 4, wherein said sensor means is located on a bearing support for said roller.

6. The veneer lathe as claimed in claim 5, wherein said roller has a diameter from one inch to six inches.

7. The veneer lathe as claimed in claim 6, wherein said roller includes a multiplicity of incising teeth.

8. The veneer lathe as claimed in claim 1 wherein the sensor means is a transducer.

9. The veneer lathe as claimed in claim 4 wherein the sensor means is a transducer.

10. The veneer lathe as claimed in claim 1 wherein the veneer lathe is a spindle type having headstocks.

11. The veneer lathe as claimed in claim 4 wherein the veneer lathe is a spindle type having headstocks.

12. The veneer lathe as claimed in claim 1 wherein the veneer lathe is a centerless type lathe.

13. The veneer lathe as claimed in claim 4 wherein the veneer lathe is a centerless type lathe.

14. The veneer lathe defined in claim 1 further including means to selectively adjustably move said carriage in response to signals from said sensor means.

15. The veneer lathe as defined in claim 14 where said means comprises electro hydraulic actuators with feedback control means.

16. The veneer lathe as defined in claim 15 wherein said actuators are linear actuators.

17. The veneer lathe as defined in claim 16 including a first linear actuator for feeding said carriage to the log, a second linear actuator for changing the knife pitch, and a third linear actuator for varying the gap between the knife cutting edge and the point of contact of the nose bar with the log.

18. In a veneer lathe of the type including means for supporting and rotating a bolt of wood about its longitudinal axis and an assembly of a veneer peeling knife and pressure nose bar with the knife and nose bar in predetermined spaced relationship relative to one another, and which assembly is supported on a carriage that moves toward the bolt during peeling veneer in ribbon form from the outside of said bolt as the latter is rotated, the improvement comprising sensor means carried by said nose bar and operative to detect and provide an output signal in response to variations in said predetermined spacing of the knife and nose bar and proportioned to the magnitude of such variation and means for adjustably repositioning the peeling knife in response to commands from a controller acting in response to signals from said sensor means to maintain said predetermined spacing and thereby control the thickness of veneer during peeling.

19. In a veneer lathe of the type including means for supporting and rotating a bolt of wood about its longitudinal axis and a veneer peeling knife and pressure nose bar assembly in which the knife and nose bar are disposed in selected spaced relationship relative to one another, and which assembly is supported on a movable carriage for peeling veneer in ribbon form from the outside of said bolt as the latter is rotated, the improvement comprising sensor means mounted on said nose bar operative to provide an output signal in response to variations in said predetermined spaced relationship of the knife and nose bar, and proportioned to the magnitude of such variation, and means for adjustably repositioning the peeling knife in response to commands from a controller acting in response to signals from said sensor means.

20. The veneer lathe as defined in claim 19 including a first linear actuator for feeding said carriage to the log and a second linear actuator for changing the knife pitch angle, said actuators being responsive to signals from said controller and being of the electrohydraulic type with feedback control means.

21. The veneer lathe as defined in claim 19 wherein said nose bar has a roller mounted thereon for rolling engagement with the bolt of wood as it is rotated.

22. The veneer lathe as defined in claim 21 wherein said roller has wood incising teeth projecting from the outer periphery thereof.

23. A veneer lathe comprising (a) a rigid frame structure;

(b) at least three parallel spaced apart rollers for carrying and rotating a log to be peeled into a ribbon of veneer mounted on said frame structure, one of said rollers being a nose bar located in a fixed position on said frame; and the other rollers being mounted for movement relative thereto;

(c) a peeling knife movably mounted on said frame and located in close proximity to said nose bar for peeling a ribbon of veneer from a log held captive between and rotated by said rollers; and (d) electrohydraulic power means operative selectively to adjustably move at least one of (i) the knife into or out of the cut, (ii) the knife to vary the pitch angle thereof; and (iii) the movable rollers to control the thickness of the veneer.

24. A veneer lathe as defined in claim 24 wherein said power means are electrohydraulic linear actuators with feedback control means.

25. A veneer lathe as defined in claim 23 including sensor means to detect variations in a predetermined spaced apart relationship of the knife and nose bar and provide output signals proportional to said variations and means operative to actuate said power means in response to said signals.

26. A veneer lathe as defined in claim 23 wherein said knife is mounted for movement relative to the log along a linear path selectively to vary the vertical gap.

27. A veneer lathe as defined in claim 26 including an electrohydraulic actuator with feed back control means for moving said knife along said linear path.

28. A veneer lathe as defined in claim 27 wherein at least one of said rollers is an incising roll.

29. In veneer lathes of the type that include means for supporting and rotating a bolt of wood about its longitudinal axis, a veneer peeling knife and a pressure nose bar with the knife and nose bar in predetermined spaced relationship relative to one another for peeling veneer in ribbon form from the outside of said bolt as the latter is rotated, the improvement comprising means mounting said knife for movement along a linear path in a direction into and out of the cut selectively to vary the vertical gap and power means connected to said mounting means for moving the knife, and sensor means mounted on said nose bar to detect variations in said predetermined spaced relationship of the knife and nose bar and provide an output signal proportional to said variations and wherein said power means is actuated in response to such output signal to minimize any variation of veneer thickness during peeling of the same from the bolt of wood.

30. The improvement as defined in claim 29 wherein the output signals from the sensor are processed by a controller and commands therefrom actuate the power means to maintain a predetermined spacing of the knife and nose bar and thereby control the thickness of veneer during peeling.

31. The improvement as defined in claim 30 wherein said power means are linear actuators.

32. The improvement as defined in claim 31 including a first linear actuator for feeding the knife to the log for peeling the veneer, a second linear actuator for changing the knife pitch, and a third linear actuator for varying the gap between the knife cutting edge and the point of contact of the nose bar with the log, and wherein at least one of said actuators are controlled by signals provided in response to variations detected by said sensor means to controllably maintain a desired veneer thickness.

33. A veneer lathe comprising (a) a rigid frame structure with pivotally mounted head stocks for carrying and rotating a log to be peeled into a ribbon of veneer;

(b) a nose bar and peeling knife mounted in predetermined spaced relationship to one another on a carriage;

(c) means movably mounting said carriage on said frame structure for movement toward and away from said log;

(d) power means for moving said carriage toward said log at a predetermined rate to peel a ribbon of veneer from the log as it is rotated;

(e) means pivotally mounting said carriage permitting adjusting the knife pitch angle;

(f) power means for selectively pivoting said carriage;

(g) means mounting said carriage permitting movement of the same to selectively vary the gap between the knife tip and point of contact of the nose bar with the log, and (h) a sensor mounted on said nose bar providing an output signal in response to changes in said predetermined spaced relationship of the knife and nose bar.

34. A veneer lathe as defined in claim 33 including power means for selectively moving the carriage as defined in paragraph (g).

35. A veneer lathe as defined in claim 33 wherein said power means are electrohydraulic linear actuators with feedback control means.

36. A veneer lathe as defined in claim 34 wherein said power means are electrohydraulic linear actuators with feedback control means.

37. A veneer lathe as defined in claim 34 including at least one of a knife deviation and veneer thickness sensing means and means actuating said power means in response to signals from the sensing means to adjustably control the quality of veneer being peeled from the log.

* * * * *